US006398613B1

(12) United States Patent
Rehkemper et al.

(10) Patent No.: US 6,398,613 B1
(45) Date of Patent: Jun. 4, 2002

(54) PUMP-POWERED TOY WITH AN ON BOARD PUMP

(75) Inventors: Steven Rehkemper; Jeffrey Rehkemper; Ryan Kratz, all of Chicago, IL (US)

(73) Assignee: Rehco LLC, Chicago, IL (US)

( * ) Notice: Subject to any disclaimer, the term of this patent is extended or adjusted under 35 U.S.C. 154(b) by 0 days.

(21) Appl. No.: 09/776,957

(22) Filed: Feb. 5, 2001

(51) Int. Cl.[7] ..... A63H 29/16
(52) U.S. Cl. ..... 446/197; 446/457
(58) Field of Search ..... 446/176, 180, 446/197, 198, 431, 448, 457, 462

(56) References Cited

U.S. PATENT DOCUMENTS 3,613,303 A * 10/1971 Allen ..... 446/186
3,789,541 A * 2/1974 Good et al. ..... 446/197
4,329,806 A * 5/1982 Akiyama et al. ..... 446/197
4,373,290 A * 2/1983 Goldfarb et al. ..... 446/197
4,897,065 A 1/1990 Festig
5,499,940 A * 3/1996 Johnson et al. ..... 446/180

* cited by examiner

*Primary Examiner*—Jacob K. Ackun

(57) ABSTRACT

In accordance with the present invention, there is provided a toy that includes a pump permanently attached thereto. More specifically, the toy vehicle includes a pump permanently secured to the vehicle and a motor mechanism that is charged or energized by pumping the pump. The vehicle may also include front and rear axle housings that are rotatably attached to the vehicle frame such that the front and rear axle housings may separately move upwardly and downwardly in relation to the vehicle frame. Shocks, which are attached to the front and rear axle/gear housings and the vehicle frame, normally bias the axle/gear housings away from the vehicle frame, providing the vehicle with an all terrain driving configuration. In addition, the axle/gear housings may be secured separately to the vehicle frame, thereby providing the vehicle with driving configurations that may be more suitable for other types of terrains.

24 Claims, 11 Drawing Sheets

PUMP-POWERED TOY WITH AN ON BOARD PUMP

FIELD OF THE INVENTION

This invention relates to pump-powered toys, and more particularly to a toy with a pump that is permanently affixed to the toy.

BACKGROUND OF THE INVENTION

Conventional toys that are powered by pumps include a means to removably attach the pump to the toy. Once attached, the user begins to energize the toy by pumping the pump. These well-known pumps are utilized to energize a motor, rotate wheels or a propeller or fill a storage means with air, such that the air provides a source of power to the motor, wheels or propeller. After the toy is sufficiently energized the pump is removed from the toy and the toy is permitted to drive or fly away from the user.

For example, U.S. Pat. No. 4,897,065 to Fertig et al. discloses a lightweight vehicle that is launched from a pump. A user, pushing the pump through a tube, forces air forward against a launch tube that is affixed to the vehicle. The force of the air through the tube pushes or launches the vehicle. For continuous use or play with the above-mentioned pump-powered vehicle, the user must retrieve or chase the toy while carrying the pump. Moreover, since these types of toys will typically only include a single pump, the ability to drive or launch the toy to another user is unlikely unless the other user also has a similar toy with a pump. Even more so, if the user loses the pump the toy's function and enjoyment is diminished. As such there is a need to provide a pump-powered toy that includes a pump that is permanently affixed to the toy.

SUMMARY OF THE INVENTION

In accordance with the present invention, there is provided a toy that includes a pump permanently attached thereto. More specifically, the toy preferably includes a pump permanently secured thereto and includes a motor mechanism for powering or rotating wheels rotatably attached to the vehicle, in which the pump energizes or powers the motor mechanism.

In the enclosed embodiments, the pump is used to (1) fill a storage means with air, which an air powered motor mechanism may draw therefrom; (2) charge an electric motor mechanism; (3) charge a flywheel motor mechanism and/or (4) wind a spring motor mechanism. All of the aforementioned may be used to rotate the wheels and drive the vehicle away from the user. More importantly, once the vehicle is driven away the user does not have to carry a pump with them because the pump is permanently secured to the vehicle.

The vehicle may also include a vehicle frame that houses a chassis gear train, which is in communication with the motor mechanism. A front and rear axle, each of which is rotatably attached to a pair of wheels, is also meshed through a series of gears to a drive gear that is rotated or driven by the motor mechanism. The front and rear axle and corresponding gear train are preferably housed separately in a front and rear axle/gear housing thereby securing and protecting the various gears and axles. The axle/gear housings are also rotatably attached to the vehicle frame such that the axle/gear housing may separately move upwardly and downwardly in relation to the vehicle frame. Shocks, which are attached to the axle/gear housings and the vehicle frame, normally bias the two away from each other, providing the vehicle with an all terrain driving configuration. In addition, the axle/gear housings may also be secured separately to the vehicle frame, thereby providing the vehicle with driving configurations that may be more suitable for other types of terrains.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
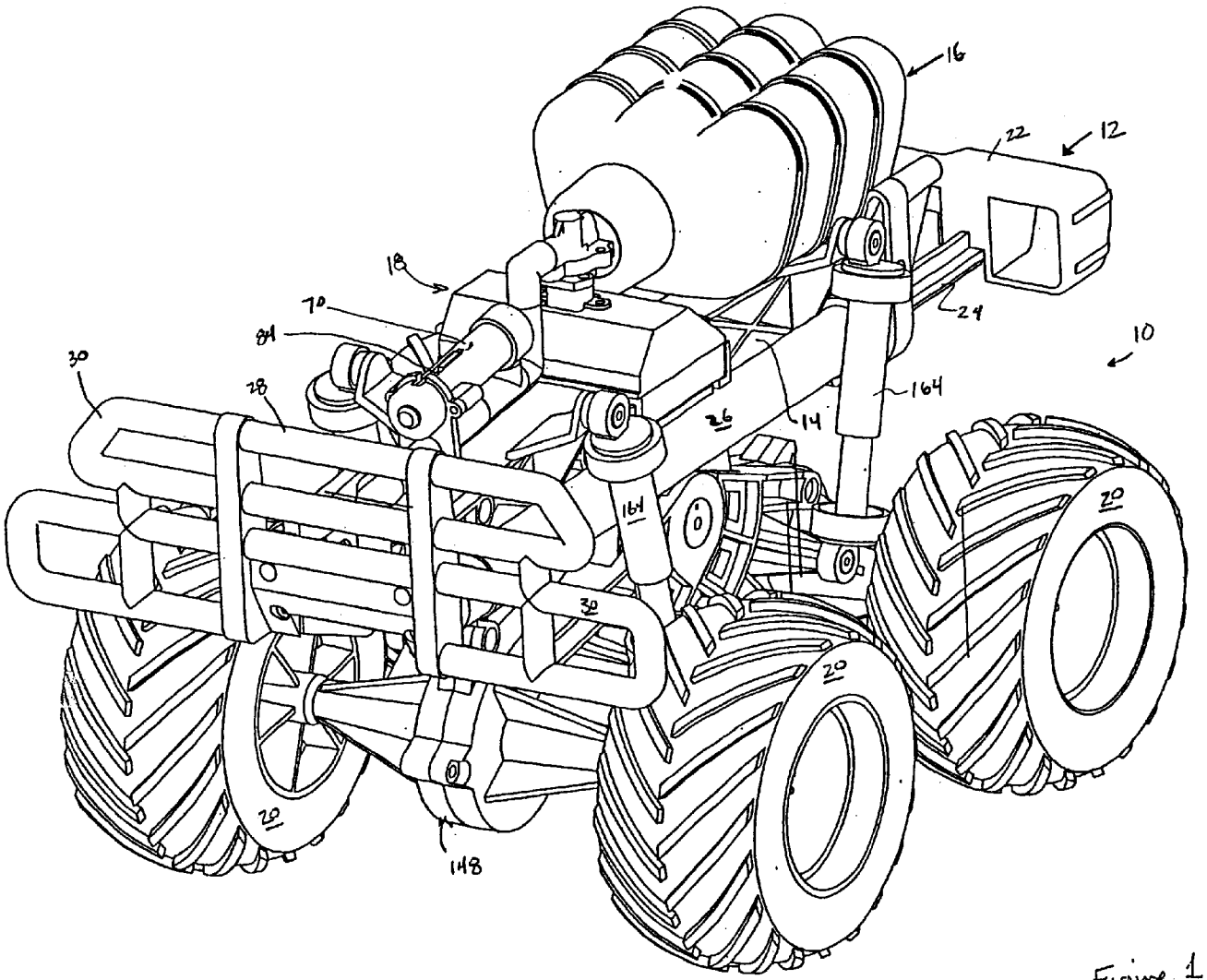
FIG. 1 is a perspective view of the toy incorporating a pump that is permanently affixed to the toy in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

With reference to the drawings, wherein like numerals indicate like elements, there is shown in FIG. 1 a perspective view of a toy vehicle indicated generally at 10. In accordance with the present invention, the vehicle 10 preferably includes a pump 12 that is permanently affixed to the vehicle frame 14. The pump 12 is used to pump air into a storage means 16, which once filled or after the user stops pumping air into it; the air may be used to power a motor mechanism. In the preferred embodiment described in FIGS. 1–5 the motor mechanism is an air powered motor mechanism 18. The power from the air powered motor mechanism 18 may then be used to drive the toy, or as illustrated throughout the various Figures, may rotate a plurality of wheels 20. However, as will become readily apparent in various other embodiments the toy may be a plane, jet, boat, or rocket and the motor mechanism may change or may be attached to other known propulsion systems such as a propeller system or inboard exhaust system.

Figure 2B:
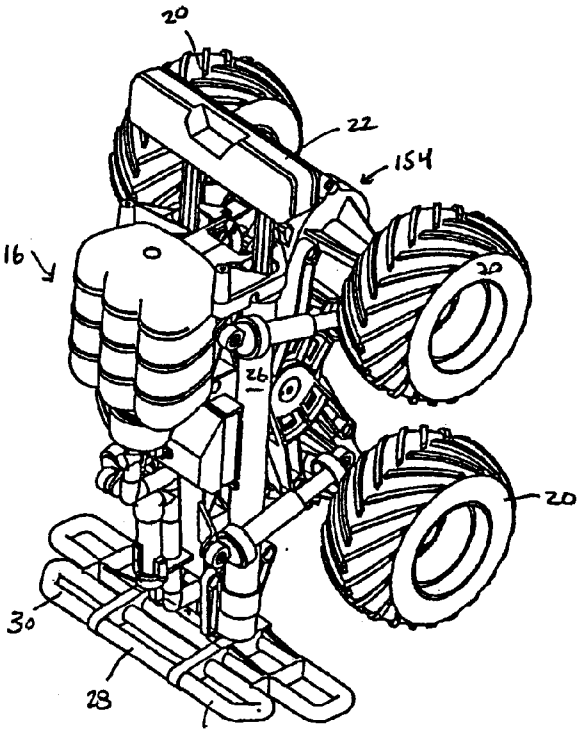
FIG. 2*b* is a perspective view of the toy illustrating the pump compressed towards the toy.
Figure 2A:
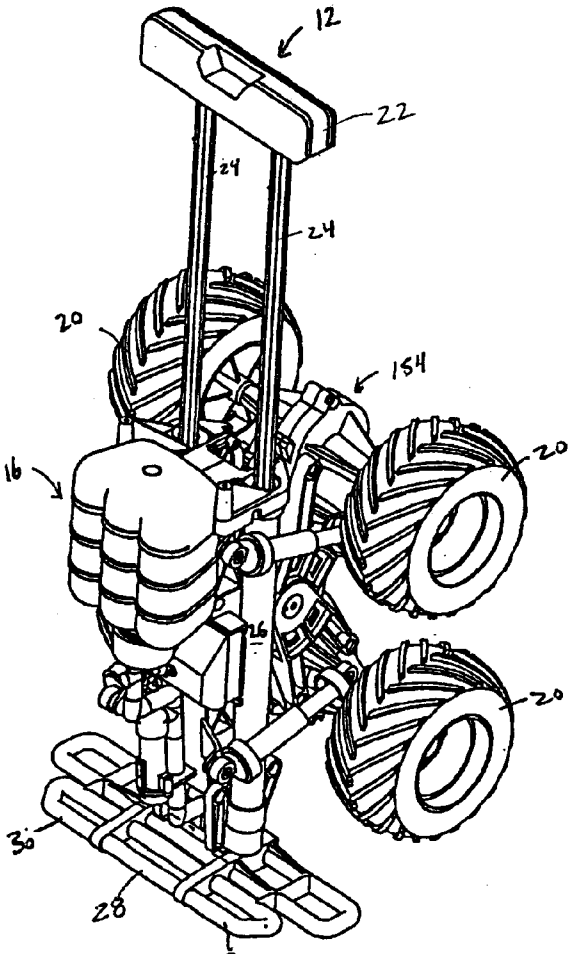
FIG. 2*a* is a perspective view of the toy illustrating the pump extended away from the toy.

Referring now to FIGS. 2*a* and 2*b*, the pump 12 includes a pump handle 22, at least one elongated pump piston 24 and a corresponding pump cylinder 26. Preferably the pump 12 includes two pump pistons and two corresponding pump cylinders, separately attached to the left and right side of the vehicle frame 14. While the pump 12 may be used while the vehicle 10 is resting horizontally on the wheels 20, the pump 12 may be more easily operated while the vehicle 10 is in a vertical position, as shown in FIGS. 2*a* and 2*b*. A user operating the pump 12 may rest the vehicle 10 vertically on an oversized front grill 28 that includes oversized ledges 30 extending from the sides of the grill 28. This provides the user with the ability to stand on top of the ledges 30, such that the vehicle 10 may be vertically held in place. The user, therefore, does not have to hold the vehicle 10 while pumping and the user will not accidentally initiate movement of the wheels 20, which, as explained in further detail below, launches the vehicle 10. To fill the storage means 16 with air, the user pulls the pump handle 22 away from the truck, extending the pump pistons 24 out of the pump cylinders 26 as illustrated in FIG. 2*a*, and then pushes the pump handle 22 towards the truck 10, compressing the pump pistons 24 into the pump cylinders 26 as illustrated in FIG. 2*b*, forcing air into the storage means 16.

As described herein below, a specific embodiment of the invention is shown in in FIGS. 1 through 7. The vehicle 10 has a vehicle frame 14, which is defined by a two-piece chassis housing 32 and 34. Each chassis housing, discussed in greater detail below, has a front end 36 and a rear end 38, similarly orientated as a typical toy vehicle. The vehicle 10 also includes a pump 12, which is permanently affixed thereto. The pump 12 includes a pair of pump pistons 24 that are inserted into corresponding pump cylinders 26. When the pump pistons 24 are pushed through the pump cylinders 26, air is forced through the pump cylinder 26 into the storage means 16, discussed in greater detail below. To prevent air from escaping out of the pump cylinders 26, a pump seal 40 is attached to the head 25 of each pump piston 24 that is going to be inserted into the pump cylinders 26, forming a gas tight seal between the two. The other end, of the pump pistons 24, attaches to the pump handle 22.

Figure 3:
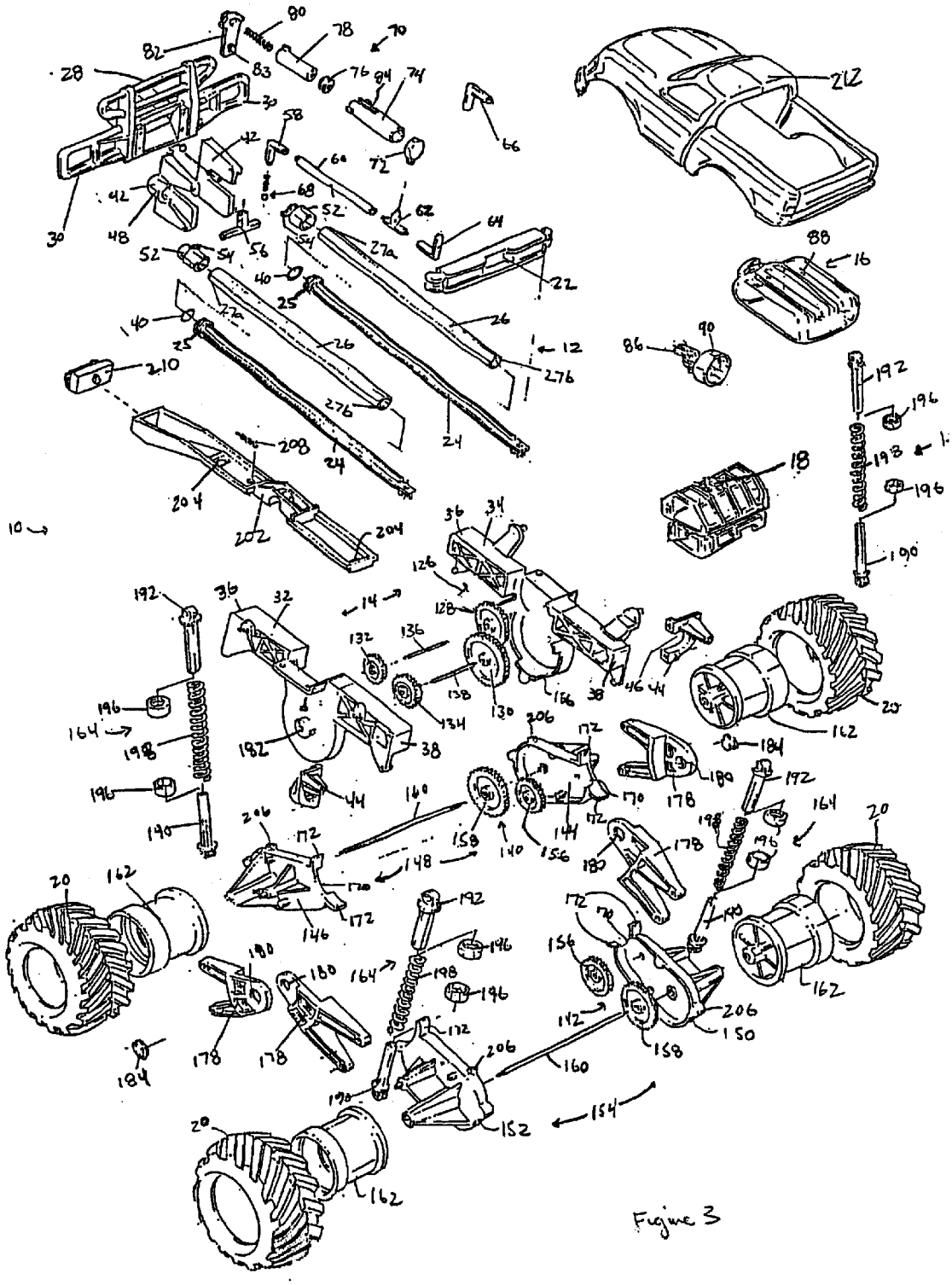
FIG. 3 is an exploded view of the toy vehicle in accordance with the present invention.
Figure 4B:
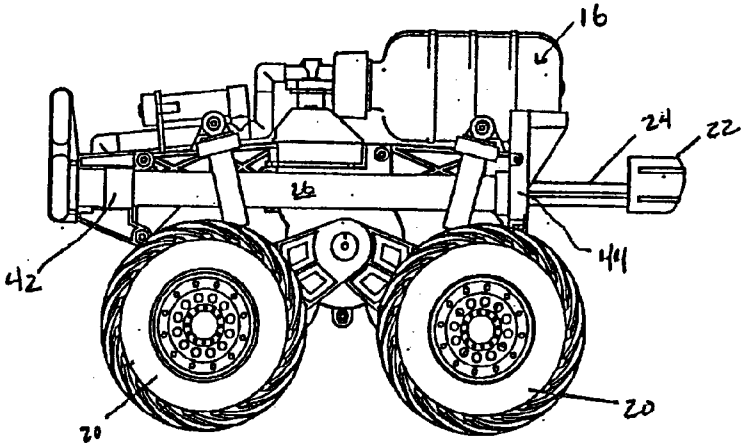
FIG. 4*b* is a left side view of the vehicle in FIG. 1.
Figure 4A:
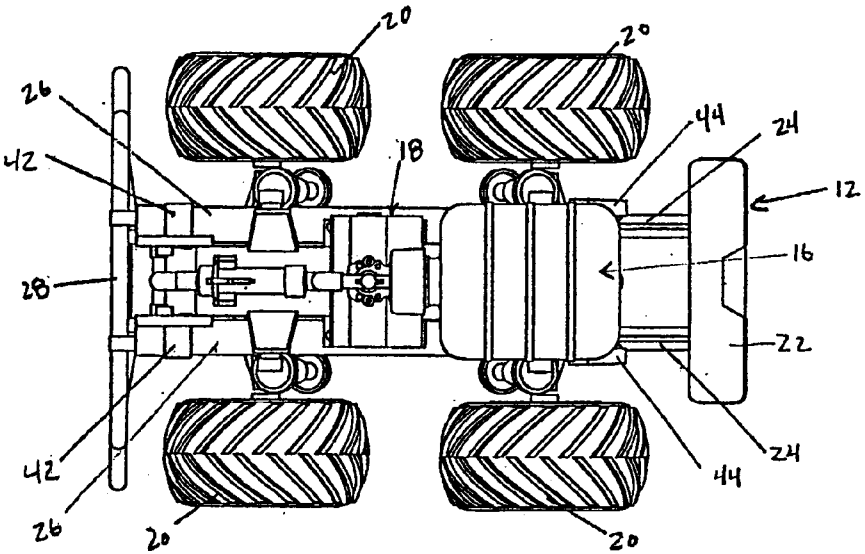
FIG. 4*a* is a top view of the vehicle in FIG. 1.
Figure 5:
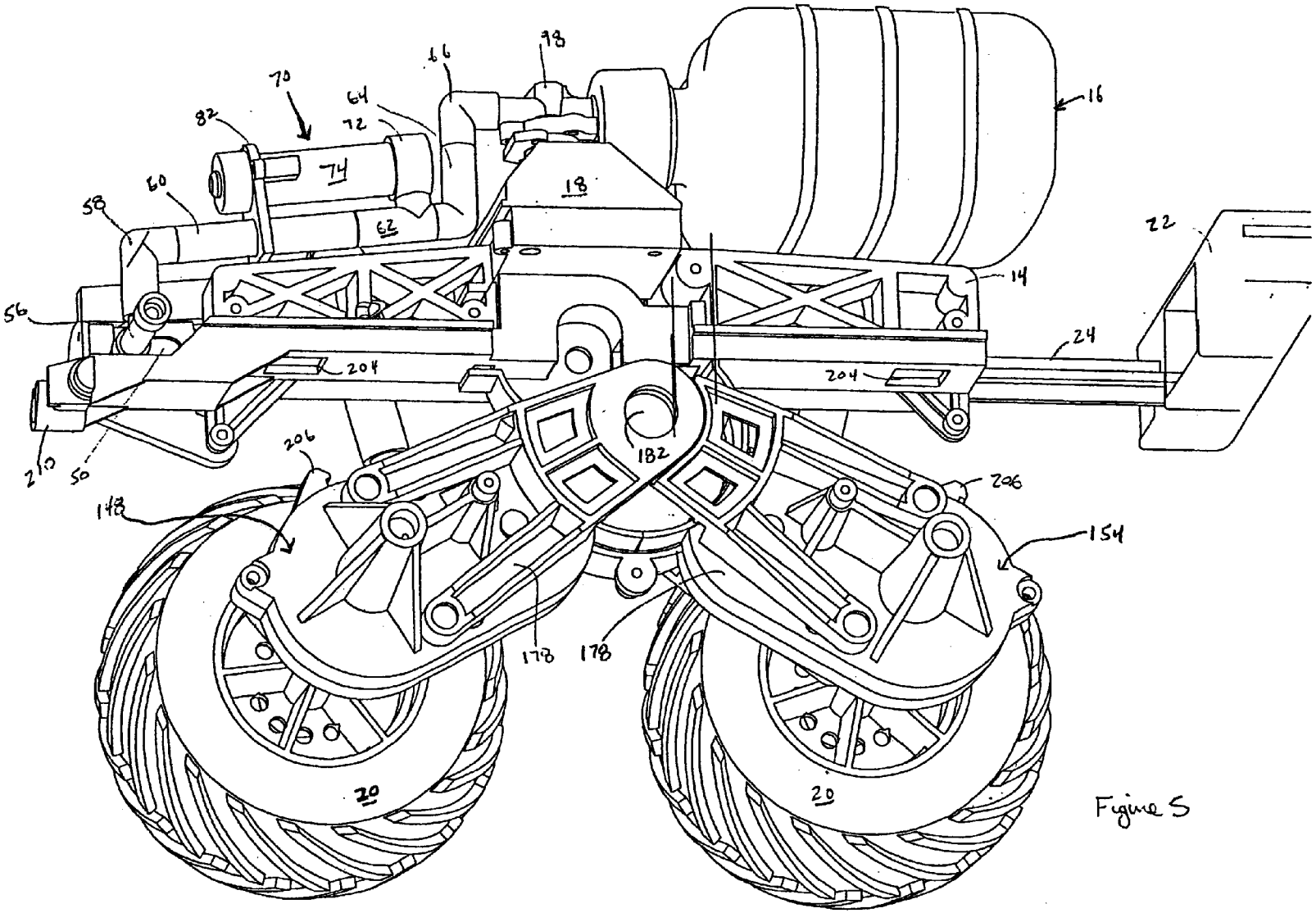
FIG. 5 is a partial side view of the toy vehicle, illustrating the line feed utilized to direct the air into the storage means.

In order to permanently affix the pump 12 to the vehicle 10, front and rear braces 42 and 44 secure each pump cylinder 26 to one of the chassis housings 32 and 34 (best illustrated in FIGS. 4*a* and 4*b*). Still referring to FIG. 3, each rear brace 44 include a recess 46, which is sized to receive the rear end 27*b* of the pump cylinder 26. Once the pump cylinders 26 are secured in the recesses 46, the rear braces 44 are secured to the rear ends 38 of the chassis housings 32 and 34.

Each front brace 42 includes a circular protrusion 48 and an open region 50. The circular protrusion 48 is sized to receive a cylinder cap 52, which is attached to the front end 27*a* of each pump cylinder 26. The cylinder cap 52 also includes a protruding line 54, defined extending outwardly from each cylinder caps 52. The protruding line 54 is received in the open region 50 of the front brace 42 (illustrated in FIG. 5). The front braces 42 are also separately fastened to the front end 36 of the chassis housings 32 and 34. When air is forced through the pump cylinders 26, the air is directed through the protruding lines 54, on each cylinder cap 52, into a first T-connector 56. By connecting the two protruding lines 54 into the first T-connector 56, a single line may be used to direct the air into the storage means 16, discussed in further detail below. However, it is contemplated by the present invention that both pump cylinders 26 may include separate lines into the storage means 16. In addition, the front braces 42 are secured to the front grill 28 thereby securing the front grill 28 to the front end 36 of the vehicle frame 14.

As mentioned above, the air is directed from the pump cylinder 26, into the first T-connector 56. From the first T-connector 56, the air is directed through a series of connectors 58, 60, 62, 64 into a manifold connector 66. To prevent air from reentering the pump cylinders 26 after it is pumped past the first T-connector 56, a one-way valve 68 may be positioned between the first T-connector 56 and the first connector 58, in the series thereof. The one-way valve 68 permits air to enter the series of connectors, when air is pumped therethrough and prevents air from traveling back therethrough. As such, the vehicle 10 may be orientated in any direction while being pumped, since the one-way valve 68 remains closed when air is not being forced through.

In addition, a pressure release valve 70 may be attached along the series of connectors, and specifically is attached to the third connector 62. The pressure release valve 70 includes a valve intake cap 72, a valve sleeve 74, a valve piston seal 76, a valve piston 78, a valve spring 80 and a valve end cap 82. When assembled the valve sleeve 74 is secured to the valve end cap 82. As illustrated best in FIG. 5, the pressure release valve 70 is positioned above the second connector 60 in the series of connectors and held in position by the valve end cap 82, which includes an aperture 83 that is sized to fit over the second connector 60. While air is entering through the series of connectors, air will also enter the pressure release valve 70. If the pressure inside the connectors becomes too great, the valve piston 78 will move and compress against the valve spring 80 until air is permitted to exit the pressure release valve 70 through a pressure vent 84, which will then lower the pressure until the valve spring 80 uncompresses, returning the valve piston 78 to its original position and closing the pressure vent 84.

Continuing thereon, the manifold connector 66 feeds into an intake manifold 86, which leads to the air powered motor mechanism 18 and the storage means 16. The storage means 16 is a typical plastic bottle 88 that is secured in a gas tight fit with a bottle cap 90 that is fastened to the intake manifold 86.

The air powered motor mechanism 18 is secured to the vehicle frame 14 and may be further defined as any air powered piston motor mechanism that may draw air from the bottle 88 in order to turn a drive gear (not shown) which is meshed to a series of gears 126, which is in communication with the wheels 20, discussed in greater detail below. In addition, the air powered motor mechanism 18 may include a means of preventing the air from initially entering therethrough. Such means may include well-known flow values that open and close with the cycle of the air powered piston. In addition the preventing means may be further self-actuated by the using pushing or turning the wheels, since the air powered motor mechanism 18 is utilized to turn the drive gear, operating the wheels may in turn activate the first cycle of the air powered piston.

Figure 6:
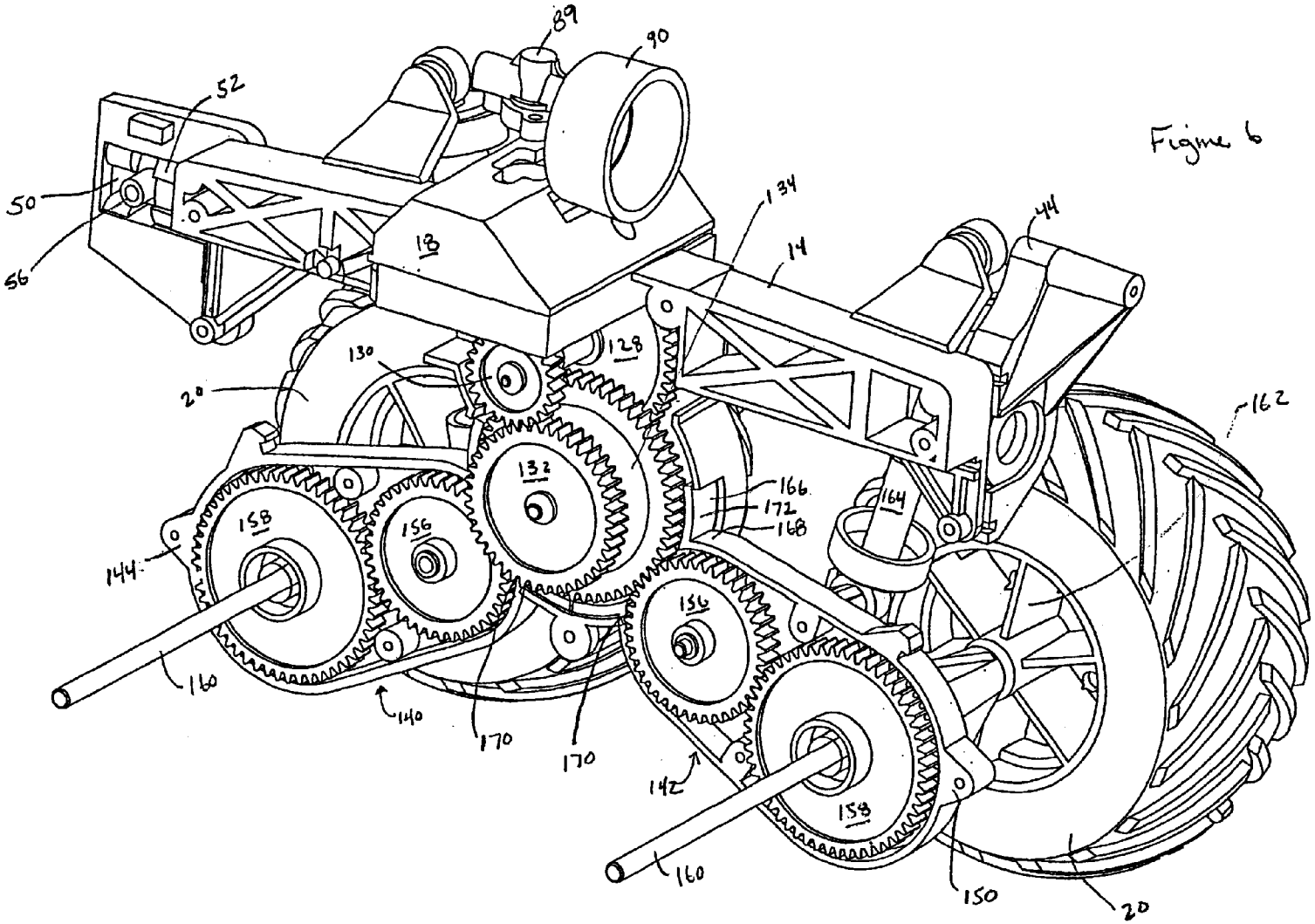
FIG. 6 is a partial view of the gear train utilized to translate the motion from the motor mechanism to the wheels and visa versa.

Referring now to FIGS. 3 and 6, the series of gears 126 are mounted and secured within the chassis housings 32 and 34 and include, a first gear 128 meshed directly with the drive gear 122 and secured to a second gear 130 on a first axle 136. The second gear 130 is meshed to a third gear 132, which is secured to a fourth gear 134 on a second axle 138. The fourth gear 134 is meshed with both a front and rear set of gears 140 and 142, respectively. The front set of gears 140 is contained within a two-piece front axle/gear housing 144 and 146 (generally referred to as the front axle/gear housing 148), while the rear set of gears 142 is contained within a two-piece rear axle/gear housing 150 and 152 (generally referred to as the rear axle/gear housing 154). Both the front and rear set of gears 140 and 142 include an inner gear 156 that is directly meshed to the fourth gear 134 and is rotatably mounted within its respective left and right axle/gear housings and is also meshed to an outer gear 158 that is mounted on an axle 160, which is secured to a pair of hubs 162, on which the wheels 20 are placed.

The front and rear axle/gear housings 148 and 154 are also preferably rotatably attached to the vehicle frame 14 at the center of the fourth gear 134. This permits the gears to rotate and always remain meshed with the fourth gear 134 regardless of the position of the wheels 20 and the gear housings 148 and 154. Normally biased downwardly by a pair of shocks 164, the front and rear axle/gear housings 148 and 154 may move upwardly and downwardly independently of each other, as illustrated in FIGS. 7*a*–7*d*. This movement is provided within the connection between the axle/gear housings 148 and 154 and the vehicle frame 14.

Still referring to FIGS. 3 and 6, when the vehicle 10 is assembled, the chassis housings 32 and 34 form openings 166 sized to receive an end 168 of the axle/gear housings 148 15 and 154. Similarly, both axle/gear housings 148 and 154 include an opening 170 that permits the inner gears 156 to mesh with the fourth gear 134. The openings 166 in the assembled chassis housings are also larger than the received ends 168 to permit the axle/gear housings 148 and 154 to move upwardly and downwardly. To prevent material from entering into the meshed gears, the axle/gear housings 148 and 154 include curved flanges 172 extending from the received end 168 that are longer then the openings 166 in the assembled chassis housings 32 and 34.

To prevent the axle/gear housings 148 and 154 from separating from the assembled chassis housings 32 and 34 a pair of swing arm claddings 178 are fastened to both the front and rear axle/gear housings 148 and 154. The swing arm claddings 178 include an aperture 180 that is sized to fit over a cylinder 182 protruding from the left and right chassis housings 32 and 34. Lastly, to secure the claddings 178 to the chassis housings 32 and 34, a cladding cap 184 is fastened to the cylinder 182.

As mentioned above, each shock 164 biases the front and rear axle/gear housing 148 and 154 downwardly. Each shock preferably includes a lower shock arm 190, which slides into an upper shock sleeve 192. Both the lower shock arm 190 and the upper shock sleeve 192 include a cap 196. Each cap 196 has an aperture that permits the cap 196 to slide over the lower shock arm 190 or the upper shock sleeve 192; however, the caps 196 may alternatively be integrally molded thereto. The caps 196 are thereafter fastened to either the axle/gear housing 148 and 154 or the chassis housings 32 and 34. A shock spring 198 is positioned between the caps 196 and biases the lower shock arm 190 and the upper shock sleeve 192 away from each other.

Figure 7B:
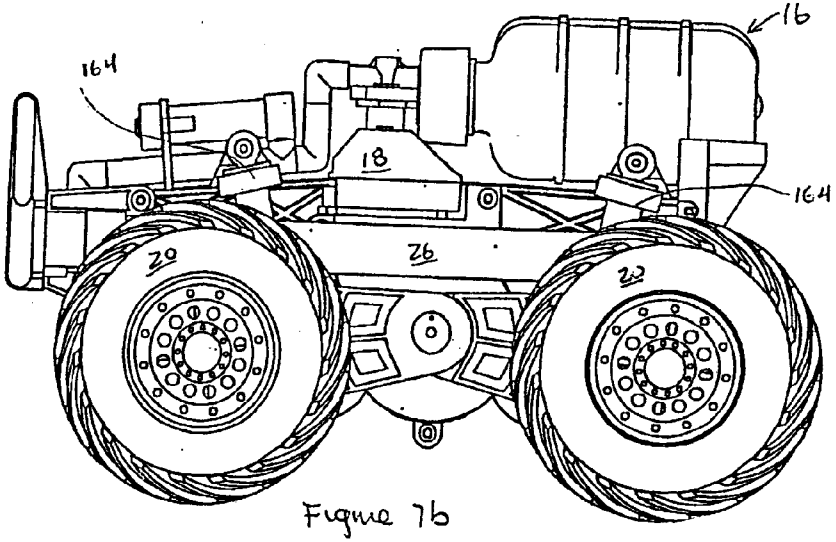
FIGS. 7*a*–7*d* depict the vehicle in four distinct configurations that the vehicle may be positioned in by locking the front and/or rear axle/gear housings against the vehicle frame.
Figure 7A:
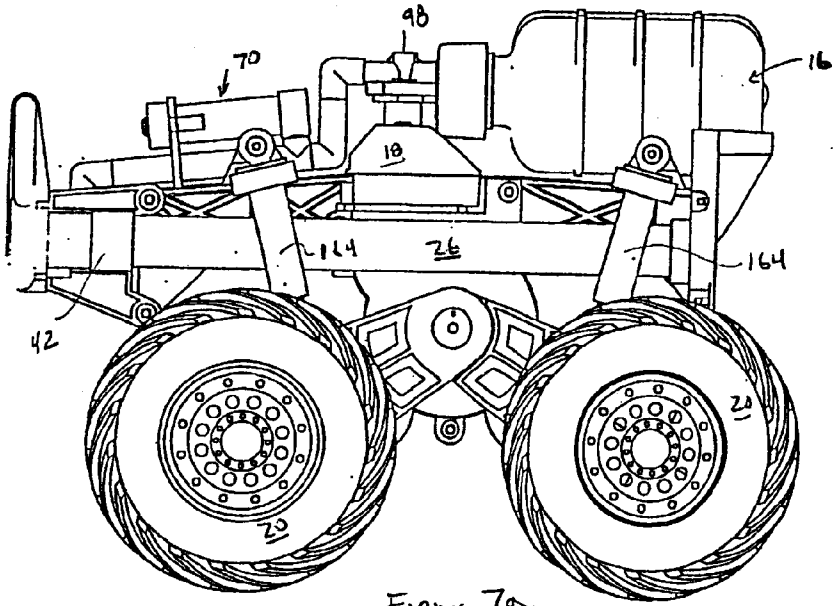
Figure 7D:
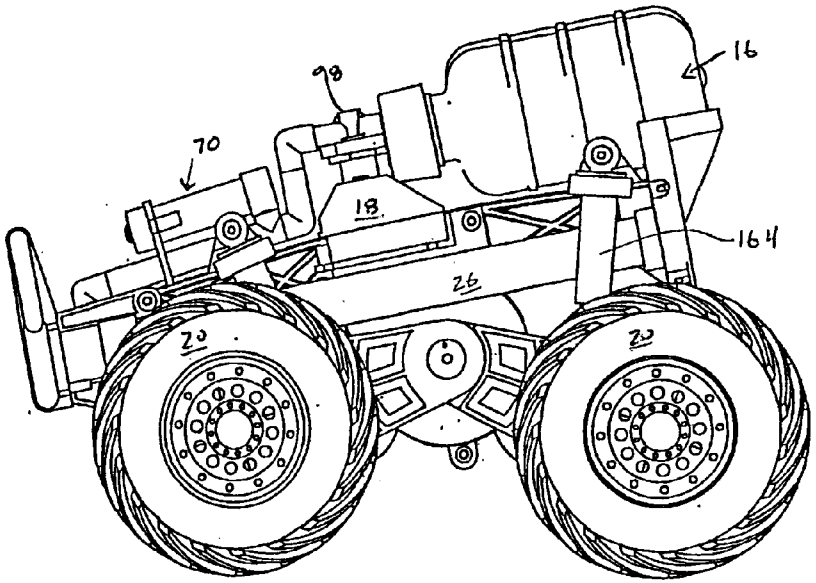
Figure 7C:
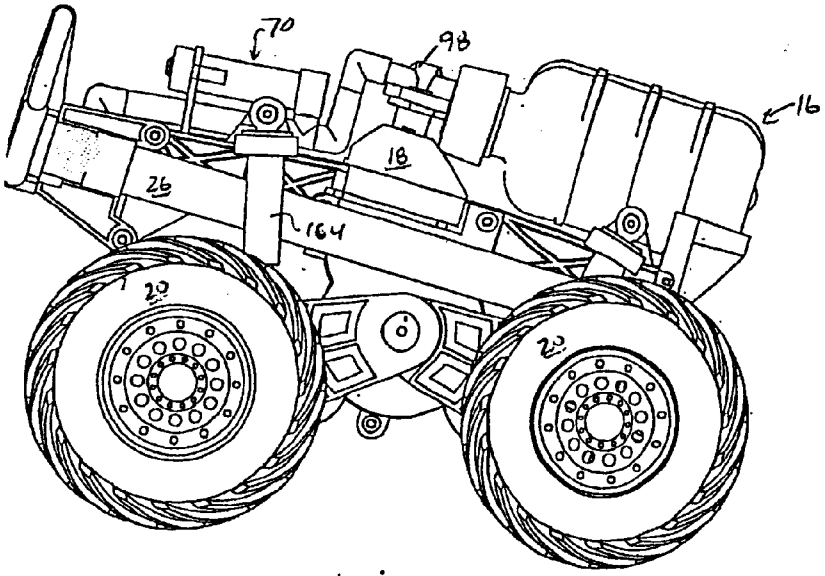

In addition, the axle/gear housings 148 and 154 may be temporarily and independently locked against the vehicle frame 14, thus providing the vehicle 10 with at least four distinct configurations, shown in FIGS. 7a through 7d. The configurations includes: unlocking both the front and rear axle/gear housings 148 and 154 such that all four shocks 164 are uncompressed (FIG. 7*a*); a second configuration includes locking both the front and rear axle/gear housing 148 and 154, such that all of the shocks 164 are compressed (FIG. 7*b*); and the third and fourth configurations include locking either the rear axle gear housing 154 (FIG. 7*c*) or locking the front axle gear housing 148 (FIG. 7*d*).

In order to temporarily and independently lock the axle/gear housings 148 and 154 to the vehicle frame 14, the vehicle frame 14 includes a movable latching plate 202 that extends along the entire length of the vehicle frame 14. The latching plate 202 includes ledges 204 positioned to engage hooks 206 on the axle/gear housings 148 and 154, when the axle/gear housings are moved upwardly towards the vehicle frame 14. In order to unlock the hooks 206 from the ledges 204, the latching plate 202 is moved a sufficient distance until the hooks 206 disengage the ledges 204. Disposed between the latching plate 202 and the vehicle frame 14 is a latching spring 208, which normally biases the latching plate 202 such that the ledges 204 are in position to engage the hooks 206. When the latching plate 202 is moved (by a force), such that the ledges 204 disengage the hooks 206, the latching spring 208 exerts a longitudinal force on the latching plate 202 such that the latching plate 202 tends to return to its normal orientation (where the ledges 204 are in position to re-engage the hooks 206). In the embodiment of the present invention, the latching plate 202 includes a releasing member 210 that extends out in front of the front grill 28. When the vehicle 10 hits an object, for instance a wall, the releasing member 210 strikes the wall first. The impact will cause the leasing member 210 to push or move the latching plate 202 such that the ledges 204 disengage the hooks 206, which when released, the shocks 164 will return the front and/or rear axle/gear housings 148 and 154 to a normal configuration (FIG. 7*a*).

The vehicle 10 may also include an aesthetic covering 212.

In addition thereto the air powered motor mechanism 18 may be replaced with other motor mechanisms, such as a flywheel motor, an electric motor or a spring motor, in which the pump, rather than filing a storage means with air, charges or energizes the motor mechanism, such that when operating, the motor mechanism powers or rotates the wheels. In greater detail below, the pump 12 referred to in reference to the air powered motor mechanism was utilized to pump air to a reservoir or bottle. However, in the other embodiments, the pump is used to manually energize the motor mechanism or generate energy that is used by the motor mechanism. By forcing the pump handle inwardly or "by pumping the pump", the pump piston will rotate gears that in turn energize the motor mechanism, and in some motor mechanisms the energy can be stored or the energized motor mechanism can be prevented from operation until a user actuates the motor mechanism.

Figure 8:
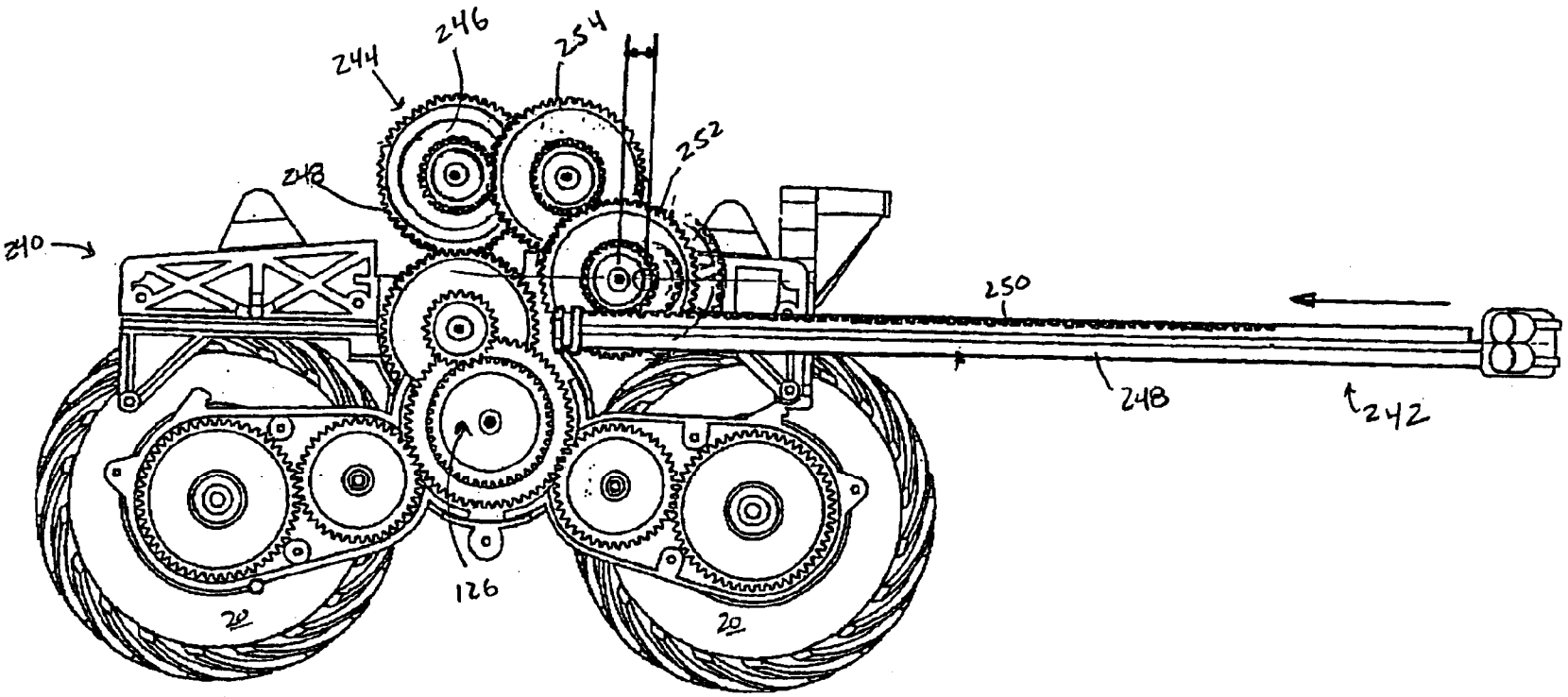
FIG. 8 is another embodiment of the vehicle employing a flywheel motor mechanism to rotate the wheels.

Referring now to FIG. 8, a cross section view is shown of a toy vehicle 240 with an on-board pump 242. The pump 242 is used, however, to energize a flywheel motor 244. The flywheel motor 244 consists essentially of a flywheel 246 secured to a drive gear 248. The drive gear 248 is further meshed to the series of gears 126 similarly described above. To charge the flywheel motor 244 a user must pump the pump 242 or push the pump piston 248 inwardly. The pump 242 includes a piston 248 with an integrated rack 250 that meshes with a slider gear 252. The slider gear 252 laterally moves when the piston 248 is pushed inwardly towards the vehicle 240 and when the piston 248 is pulled outwardly. When the piston 248 is pushed inwardly, the slider gear 252 moves to engage and mesh with a combo gear 254 that is meshed with the flywheel motor 244. As the piston 248 continues to move inwardly the engaged slider gear 252 continues to rotate, which will further rotate and charge the flywheel motor 244. When the piston 248 is pulled outwardly, the slider gear 252 disengages with the combo gear 254 and moves to an idle position such that the flywheel motor 244 will only be rotated in a single direction. Once the flywheel motor 244 is sufficiently energized the vehicle may be placed on a surface and be driven away by the stored inertia energy from the flywheel 246. The flywheel motor mechanism 244 described does not include a means for preventing the stored inertia energy from releasing, as such when the pump 242 is pulled outwardly, the flywheel 246 will utilize some of its stored energy by rotating the wheels 20. However, if the user repeats the pumping action quickly, the flywheel motor mechanism 244 will increase inertia, more than it will expel, such that when the vehicle 240 is placed on the surface the already rotating wheels 20 will sufficiently drive the vehicle 240 away from the user, with the pump 242 remaining attached thereto. There would be a point in which the energy added is equal to the energy being expelled such that at this equilibrium, no addition energy would be added even with additional pumping. In addition, it is fully appreciated that the vehicle 240 may include the aforementioned preventing and self-actuating means.

Figure 9:
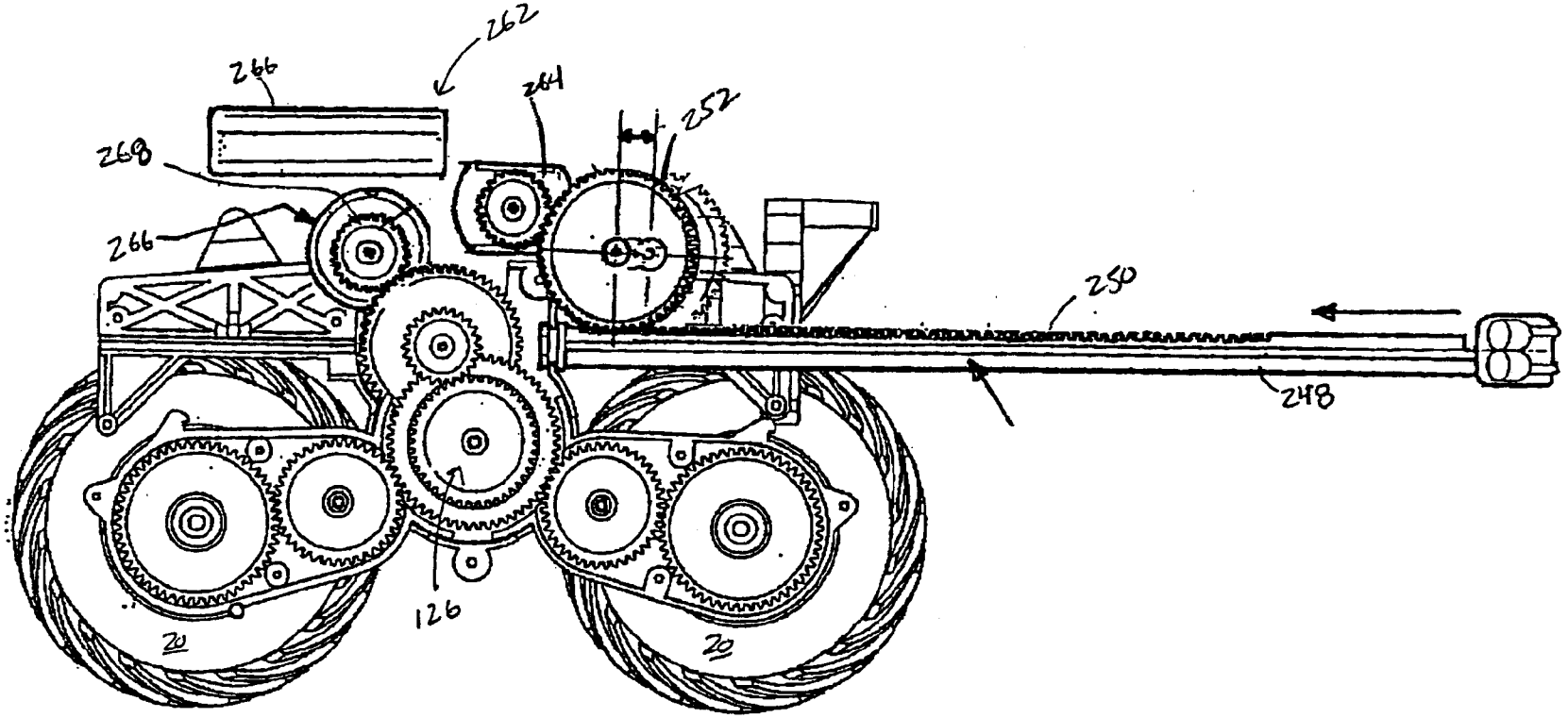
FIG. 9 is another embodiment of the vehicle employing an electric motor mechanism.

In another embodiment, FIG. 9, the toy vehicle 260 includes an electric motor 262. When the piston 248 is pushed inwardly, "or the pump 242 is pumped", the slider gear 252 moves to engage and rotate a charging motor 264. The charging motor 264 is in communication with a capacitor 266, which stores the energy received from the rotating charging motor 264. The energy is released from the capacitor 266 to drive a motor 266 that rotates a drive gear 268 meshed to the series of gears 126. It is fully appreciated by this invention that other means of storing electricity may be employed, for instance nickel-cadmium batteries may be used. As with the flywheel motor mechanism 244, repeating of the pumping action increases the electricity stored in the storage means. In addition, the electric motor mechanism 262 may also include preventing and self-actuating means.

Figure 10:
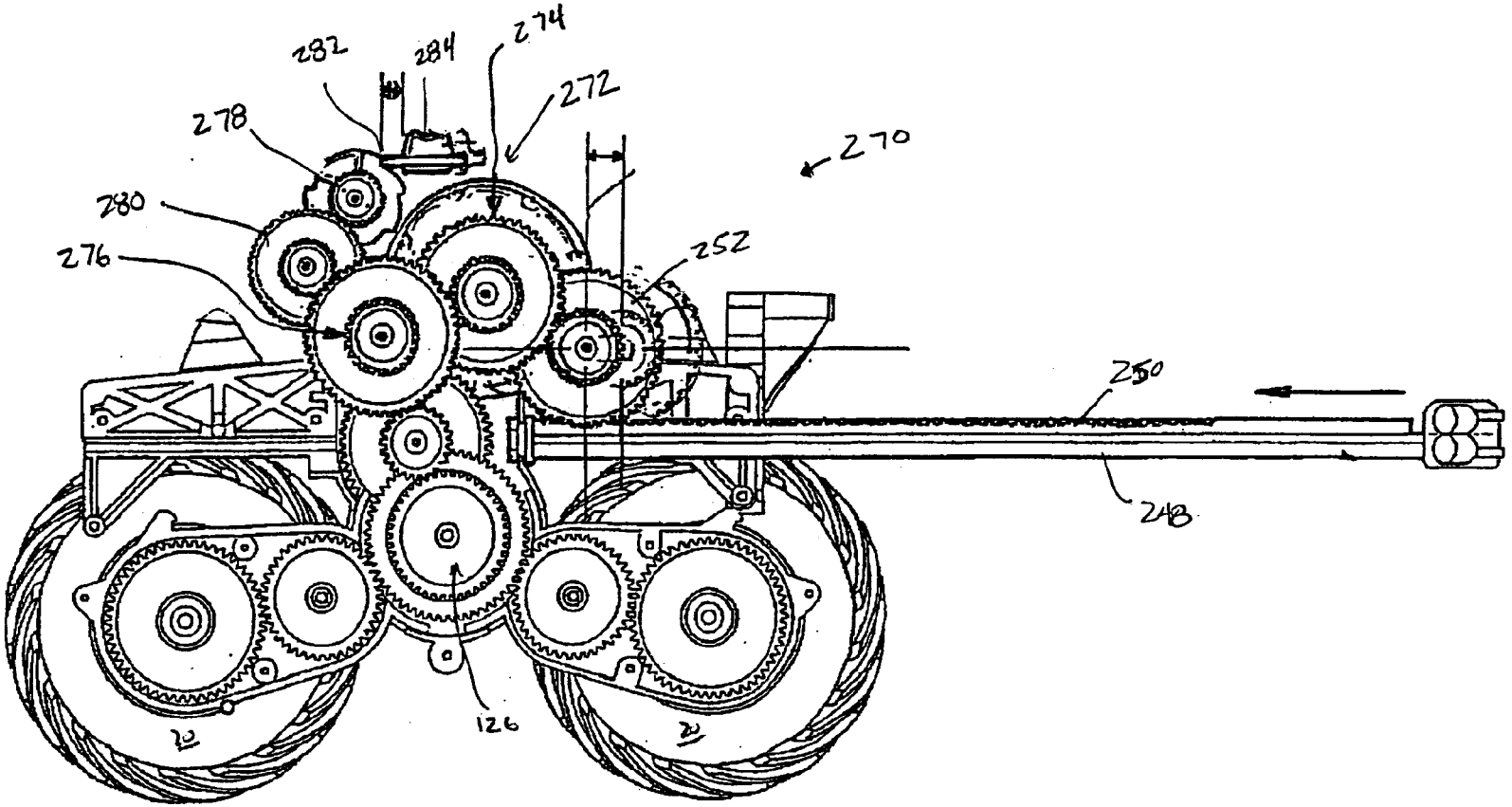
FIG. 10 is yet another embodiment of the present invention employing a spring motor mechanism.

In yet another embodiment, FIG. 10, the toy vehicle 270 includes a spring motor 272. When the piston 248 is pushed inwardly, or the user "pumps the pump 242", the slider gear 252 engages, rotates and winds a tension spring gear 274, creating and storing energy. The spring gear 274 is meshed to the drive gear 276 that rotates the series of gears 126. To prevent the spring gear 274 from unwinding, when the piston 248 is being pulled outwardly, a ratchet mechanism 278 is meshed with a combo gear 280, which is directly meshed to the drive gear 276. The ratchet mechanism 278 has a slot 282 that engages and locks with a mechanical switch 284, when the switch 284 is in the lock position, such that the ratchet mechanism 278 permits the spring gear 274 to wind but not unwind. When the switch 284 is moved to the release position, the ratchet mechanism 278 may freely rotate, permitting the spring gear 274 to unwind, releasing its energy and driving or rotating the wheels 20.

In addition, the on-board pump may be easily attached to a standard two wheel drive vehicle with a rigid chassis or frame, without the need for shocks, suspension or a rotatably front and rear axle. It is readily apparent from the description above, that the motor mechanism may be attached to other propulsion systems such that the present invention described above could power a boat, plane, jet, or rocket. For instance, the motor mechanism could easily be attached to a propeller to launch a plane, or be attached to an inboard exhaust engine or propeller to drive a boat.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A toy vehicle comprising:

at least two pairs of wheels rotatably connected to a vehicle frame defined by said vehicle;

a means of rotating at least one of the pairs of wheels; and a pump permanently attached to said vehicle frame, the pump is in communication with the rotating means such that pumping said pump rotates the rotating means thereby rotating the at least one pair of wheels, wherein a user sufficiently pumping said pump, rotates the at least one pair of wheels such that placing said vehicle on a surface may cause said vehicle to drive away from the user, and wherein said pump remains affixed thereto.

2. The vehicle of claim 1 wherein the rotating means includes a motor mechanism operably connected to at least one of the pairs of wheels, such that when the motor mechanism is energized and operating, said wheels rotate, and wherein the pump is further in communication with the motor mechanism such that pumping said pump energizes said motor mechanism.

3. The vehicle of claim 2 wherein:

the motor mechanism is an air powered motor mechanism; and the pump includes:

at least one cylinder permanently attached to said vehicle frame, each cylinder having a first end in communication with the air powered motor mechanism; and an elongated piston corresponding to each cylinder, each piston having a forward and a rearward end, the forward end having a head that fits into said corresponding cylinder and creates a gas tight relationship therewith, such that a user may push the rearward end of the piston through said cylinder pushing air through the first end of the cylinder energizing said air powered motor mechanism.

4. The vehicle of claim 3 further comprises:

a series of gears in communication with the air powered motor mechanism and the wheels, such that when the air powered motor mechanism is operating, the series of gears rotates;

a front and rear axle/gear train meshed with the series of gears and each axle/gear train secured to a pair of wheels; and the front and rear axle/gear train separately housed in a front and rear axle/gear housing respectively, and the front and rear axle/gear housing rotatably attached to the vehicle frame such that the front and rear axle/gear housing may separately move upwardly and downwardly in relation to the vehicle frame.

5. The vehicle of claim 4 further comprising:

a means for separately locking the front and rear axle/gear housing against the vehicle frame; and a means for releasing the locking means.

6. The vehicle of claim 5 further includes:

a storage means in communication with each cylinder and the air powered motor mechanism, the storage means storing said air pumped through each cylinder;

a means for preventing said air from entering the air powered motor mechanism, when said user is pumping air through said cylinders; and a self-actuating means for automatically releasing the preventing means and permitting the air to enter into the air powered motor mechanism, such that the air powered motor mechanism starts operating.

7. The vehicle of claim 1 further comprising:

a motor mechanism operably connected to the rotating means, such that when the motor mechanism is energized and operating, said wheels rotate, and wherein the pump has the means to energize the motor mechanism when being pumped.

8. The vehicle of claim 7 further comprising:

at least one slider gear having an idle position and an engaged position, wherein when the slider gear is in the engaged position, the slider gear is operably connected to the motor mechanism such that when the slider gear rotates, the motor mechanism energizes, and wherein said pump further includes an elongated piston corresponding to each slider gear, each piston having an integrated rack that meshes with said corresponding slider gear, such that when said piston is initially pushed inwardly towards the vehicle, the slider gear moves to the engaged position and when said piston is continually pushed inwardly therefrom, the slider gear further rotates such that the motor mechanism energizes, and when said piston is pulled outwardly away from the vehicle, the slider gear moves to the idle position.

9. The vehicle of claim 8 wherein the motor mechanism is a flywheel motor.

10. The vehicle of claim 8 wherein the motor mechanism is a spring tension motor.

11. The vehicle of claim 8 wherein the motor mechanism is an electric motor.

12. The vehicle of claim 10 or 11 further including a means for prohibiting the operation of an energized motor mechanism and a self-actuating means for automatically releasing said prohibiting means.

13. The vehicle of claim 9, 10 or 11 further comprising:

a series of gears in communication with the motor mechanism and the wheels, such that when the motor mechanism is operating, the series of gears rotates;

a front and rear axle/gear train meshed with the series of gears and each axle/gear train secured to a pair of wheels; and the front and rear axle/gear train separately housed in a front and rear axle/gear housing respectively, and the front and rear axle/gear housing rotatably attached to the vehicle frame such that the front and rear axle/gear housing may separately move upwardly and downwardly in relation to the vehicle frame.

14. The vehicle of claim 13 further comprising:

a means for separately locking the front and rear axle/gear housing against the vehicle frame; and a means for releasing the locking means.

15. The toy of claim 1 further comprising:

a vehicle frame defined by said vehicle;

a propeller mechanism rotatably connected to said vehicle frame; and a motor mechanism operably connected to the propeller, such that when said power mechanism provides power to the motor, the motor mechanism drives said propeller.

16. A toy vehicle comprising:

a means of rotating at least one of the pairs of wheels rotatably connected to a vehicle frame defined by said vehicle;

a motor mechanism operably connected to the rotating means, such that when the motor mechanism is energized and operating, said wheels rotate, a pump permanently attached to said vehicle frame, the pump is in communication with the motor mechanism such that pumping said pump energizes the motor mechanism, wherein a user sufficiently pumping said pump, energizes said motor mechanism such that placing said vehicle on a surface may cause said vehicle to drive away from the user, and wherein said pump remains affixed thereto.

17. The vehicle of claim 16 further comprising a means for storing energy, said storage means operably connected to the pump and the motor mechanism such that the energy generated by the pump is stored in said storage means and the motor mechanism when operating may draw the energy from said storage.

18. The vehicle of claim 17 wherein the motor mechanism is an air powered motor mechanism that utilizes air to rotate the rotating means and wherein the pump is used to force air into a storage bottle such that when operating the air powered motor mechanism may draw air from said storage bottle.

19. The vehicle of claim 17 wherein:

the motor mechanism is a flywheel motor that includes a flywheel operably connected to the pump and the rotating means, wherein the flywheel may store inertia energy in response to the rotation thereof and the flywheel may further rotate the rotating means in response to the stored inertia energy, and the pump includes the means to rotate the flywheel.

20. The vehicle of claim 17 wherein:

the motor mechanism is a spring tension motor that includes a tension spring gear operably connected to the pump and the rotating means, wherein the tension spring gear may store energy in response to the rotation thereof and the tension spring gear may further rotate the rotating means in response to the stored energy, and the pump includes the means to rotate the spring tension gear.

21. The vehicle of claim 17 wherein:

the motor mechanism is an electric motor that includes a charging motor connected to the pump wherein the charging motor has the means to produce energy in response to the rotation thereof, a means for storing electricity connected to the charging motor for storing the energy produce by the charging motor, and a drive motor connected to the electric storing means and the rotating means, the drive motor having the means to rotate the rotating means in response to the stored energy in the electric storing means, and the pump includes the means to rotate the charging motor.

22. The vehicle of claim 18, 19, 20 or 21 further comprising:

a series of gears in communication with the motor mechanism and the wheels, such that when the motor mechanism is operating, the series of gears rotates, a front and rear axle/gear train meshed with the series of gears and each axle/gear train secured to a pair of wheels; and the front and rear axle/gear train separately housed in a front and rear axle/gear housing respectively, and the front and rear axle/gear housing rotatably attached to the vehicle frame such that the front and rear axle/gear housing may separately move upwardly and downwardly in relation to the vehicle frame.

23. The vehicle of claim 22 further comprising:

a means for separately locking the front and rear axle/gear housing against the vehicle frame; and a means for releasing the locking means.

24. The vehicle of claim 18, 19, 20 or 21 further including a means for prohibiting the operation of an energized motor mechanism and a self-actuating means for automatically releasing said prohibiting means.

* * * * *